United States Patent [19]

Iitsuka

[11] Patent Number: 4,553,371

[45] Date of Patent: Nov. 19, 1985

[54] COIN CRIMPER

[75] Inventor: Yoshitsune Iitsuka, Yokohama, Japan

[73] Assignee: Nippon I.C.S. Co., Ltd., Osaka, Japan

[21] Appl. No.: 580,548

[22] Filed: Feb. 14, 1984

[51] Int. Cl.[4] ..... B65B 7/02

[52] U.S. Cl. ..... 53/285; 53/378; 493/159

[58] Field of Search ..... 53/380, 378, 212, 213, 53/285, 482; 493/159, 158, 109

[56] References Cited

U.S. PATENT DOCUMENTS

| | | | |
|---|---|---|---|
| 2,277,128 | 3/1942 | Miller | 493/156 |
| 2,635,402 | 4/1953 | Jorgensen | 53/212 |
| 2,904,946 | 9/1959 | Ullström et al. | 53/380 |
| 3,373,542 | 3/1968 | Ikeuchi | 53/212 X |
| 3,925,966 | 12/1975 | Ushio | 53/212 |
| 4,038,806 | 8/1977 | Rothman et al. | 53/212 X |
| 4,069,647 | 1/1978 | Horie | 53/380 X |

*Primary Examiner*—Horace M. Culver

*Attorney, Agent, or Firm*—Young & Thompson

[57] ABSTRACT

A coin crimper for curling open end edges of packages with coins packed therein includes a package receiving opening, curling apparatus for curling the open end edges of the packages inserted in the opening and driving apparatus for rotatively driving the curling apparatus. According to the invention, the coin crimper comprises package receiving opening diameter changing apparatus for changing a diameter of the package receiving opening depending upon kinds of coins and hence packages of the coins, and curling position changing apparatus for changing a curling position where the open end edges of the packages are curled depending upon the coins, thereby enabling packages of coins having different diameters to be curled by the single coin crimper.

7 Claims, 52 Drawing Figures

COIN CRIMPER

BACKGROUND OF THE INVENTION

1. Field of the Invention

This invention relates to a coin crimper for curling open end edges of cylindrical packages for packing plural coins or several tens of coins.

2. Description of the Prior Art

FIG. 1 illustrates various kinds of coins a, b and c having different diameters and various packages or packing papers A, B and C in the form of hollow cylinders for packing the coins a, b and c. FIG. 2 illustrates the packing paper A in section whose open end edge A' is curled after the coins a have been packed therein.

There have been proposed various kinds of apparatuses for curling the open end edges of packing papers (coin crimper). With all of the apparatuses, attachments mounted on ends of rotary shafts of the apparatuses must be replaced with other attachments depending upon the kinds of coins or diameters of cylindrical packages. Such hitherto used apparatuses are, therefore, troublesome in handling with low operating efficiency and are required to prepare the attachments corresponding to the kinds of coins to be packed.

SUMMARY OF THE INVENTION

It is a primary object of the invention to provide an improved coin crimper which eliminates the above disadvantage of the prior art.

It is another object of the invention to provide a coin crimper capable of changing a diameter of an opening for inserting open ends of coin packages by rotatively operating the protrusion or lever of the cam plate and capable of changing radial positions of a nail and a roller of a curling mechanism for curling the open end edges of the coin packages so as to be able to curl open end edges of packages for all kinds of coins having different diameters, thereby obtaining significant effects to facilitate handling of coin crimper and to remarkably improve its working efficiency.

In order that the invention may be more clearly understood, preferred embodiments will be described, by way of example, with reference to the accompanying drawings.

DETAILED DESCRIPTION OF THE PREFERRED EMBODIMENT

Figure 3C:
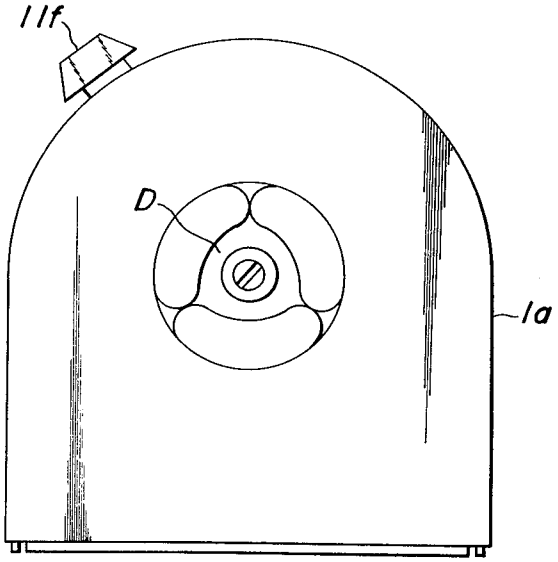
FIG. 3*c* is a plan view of the coin crimper shown in FIG. 3*a;*
Figure 3B:
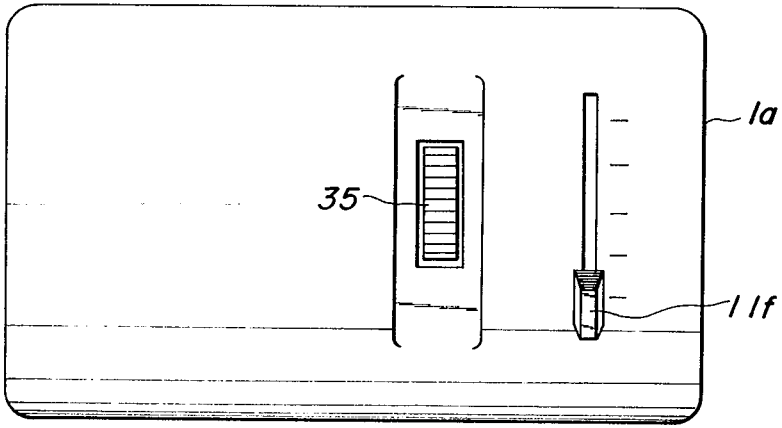
FIG. 3*b* is a front elevation of the coin crimper shown in FIG. 3*a;*
Figure 3A:
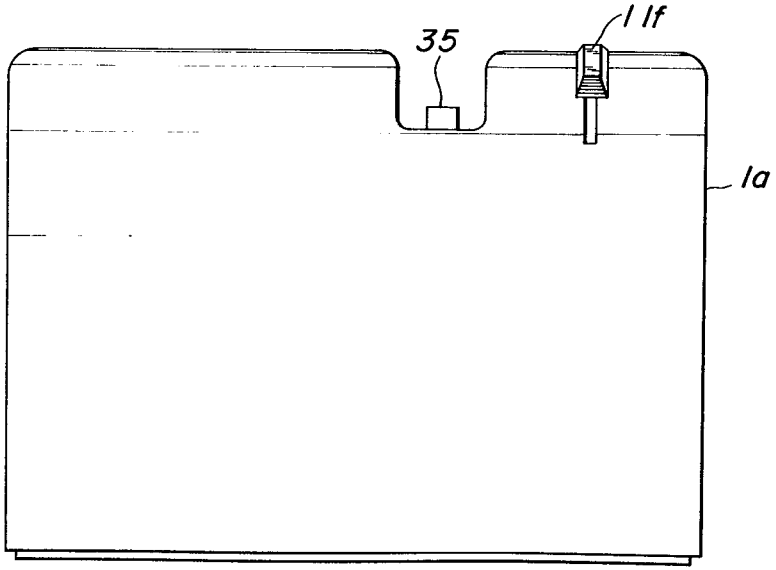
FIG. 3*a* is a side view of a coin crimper according to the invention.
Figure 4:
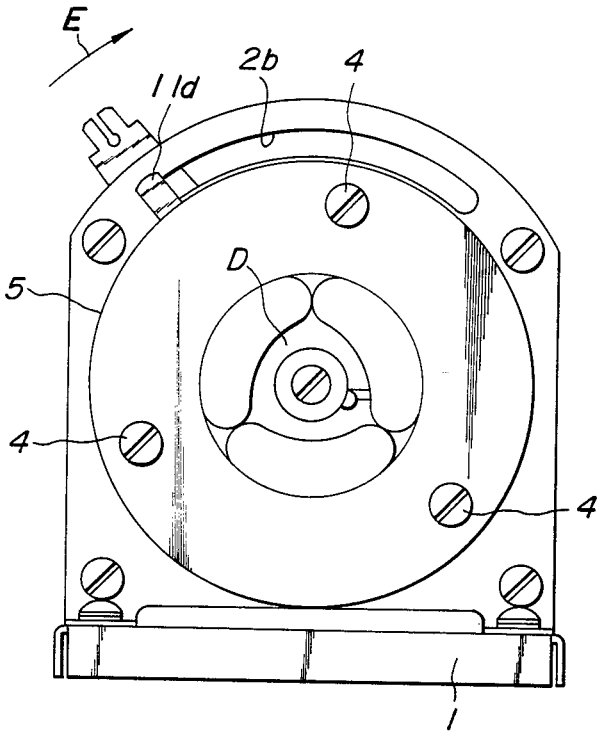
FIG. 4 is a front elevation of the coin crimper shown in FIG. 3*a* after removal of a cover.
Figure 5:
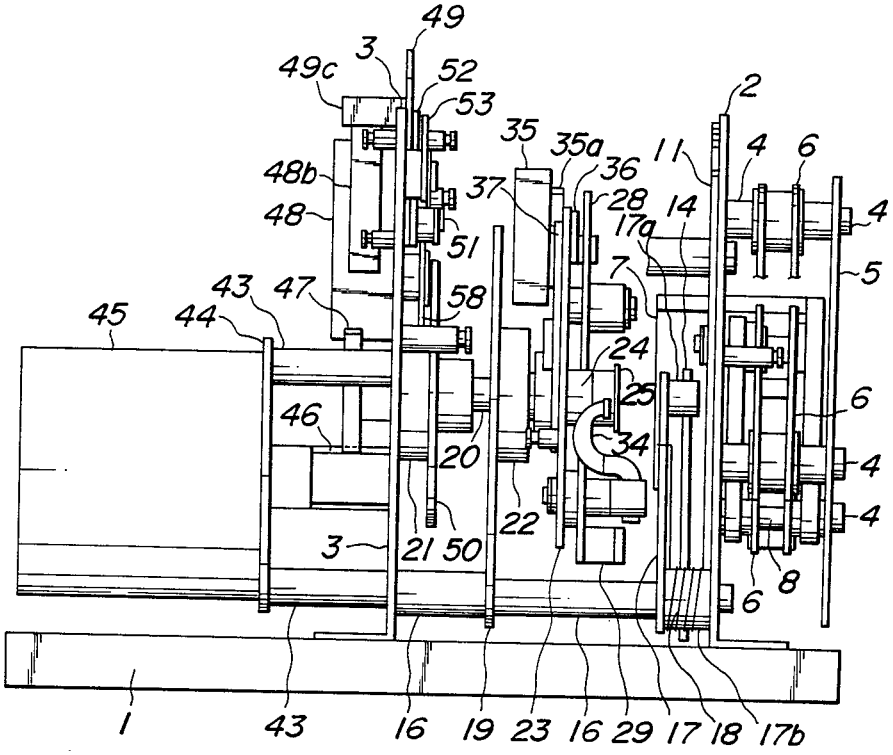
FIG. 5 is a side view of the coin crimper partially removed.
Figure 6:
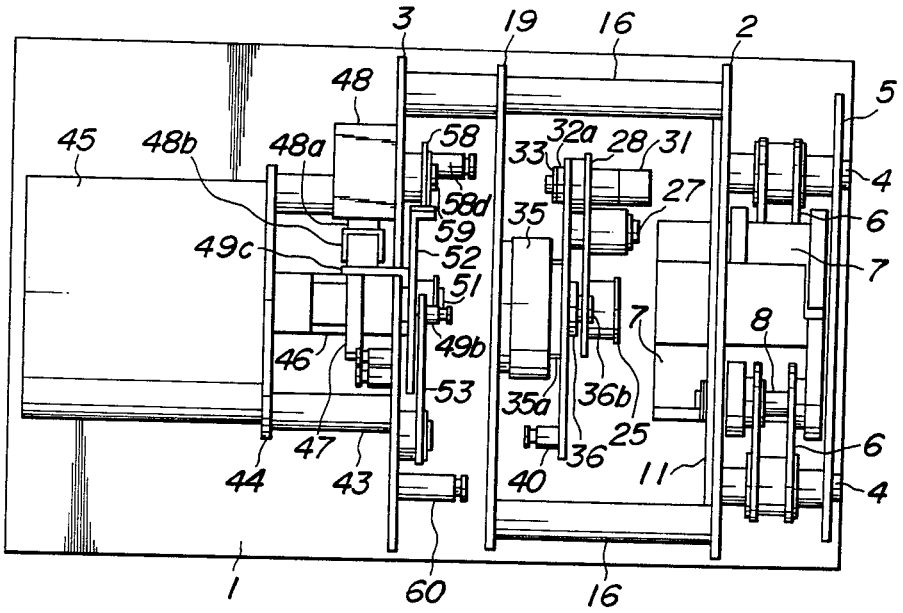
FIG. 6 is a plan view of the coin crimper shown in FIG. 5.

FIGS. 3*a*–3*c* illustrate one embodiment of a coin crimper according to the invention. Referring to FIGS. 4–6 illustrating the coin crimper shown in FIGS. 3*a*–3*c* after removal of a cover 1*a,* the crimper comprises a front vertical plate 2 and a rear vertical plate 3 arranged on a base plate 1 on its front and rear sides.

In this specification and claims, the term "front or forward" means a side on which a package is inserted into the crimper or a right side of FIG. 5 and the term "rear or rearward" means a side opposite to the above side or a left side of FIG. 5.

Figure 7A:
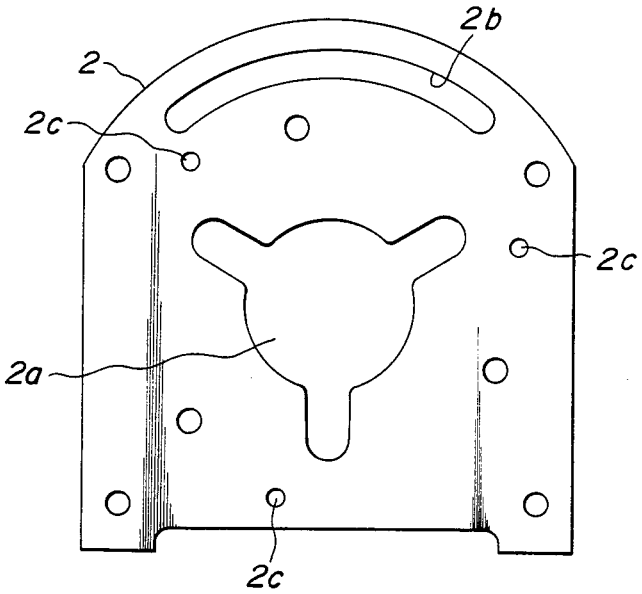
FIG. 7*a* is an elevation of a front vertical plate of the crimper as viewed from a rear side according to the invention.
Figure 7B:
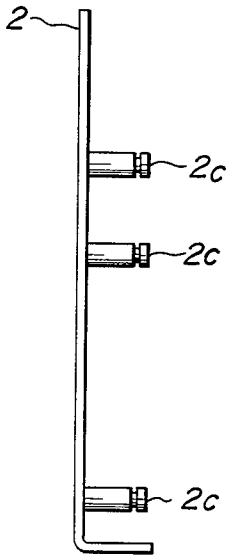
FIG. 7*b* is a side view of the front vertical plate shown in FIG. 7*a;*

FIG. 7 illustrates in detail the front vertical plate 2 formed with a center hole 2*a* and an arc-shaped slot 2*b* located in its upper portion and provided with three spring anchoring pins 2*c* extending therefrom.

Figure 8A:
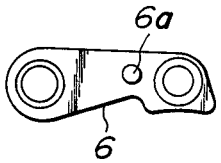
FIG. 8*a* is a front view of an arm for supporting a pressure core for changing a package receiving opening of the crimper according to the invention.
Figure 8B:
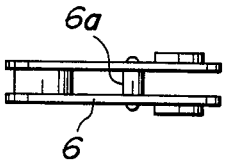
FIG. 8*b* is a plan view of the arm shown in FIG. 8*a;*
Figure 9:
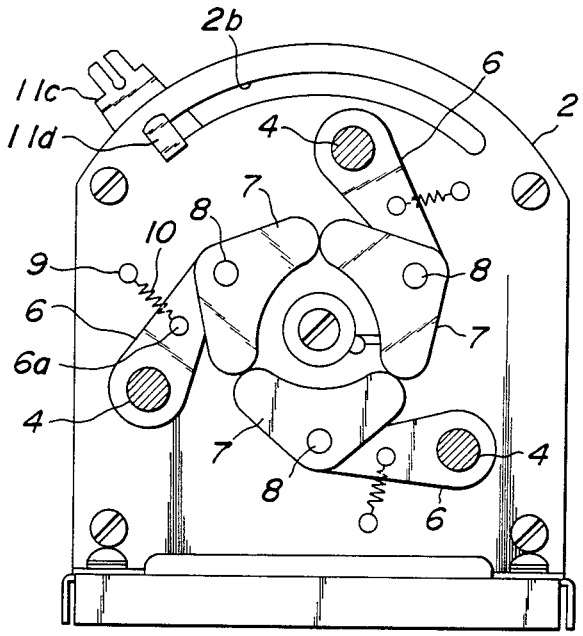
FIG. 9 is a front elevation of a mechanism for changing a diameter of the package receiving opening of the crimper according to the invention.
Figure 10A:
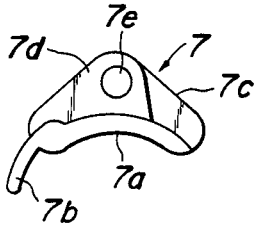
FIG. 10*a* is an elevation of the pressure core shown in FIG. 9 as viewed from the rear side.
Figure 10B:
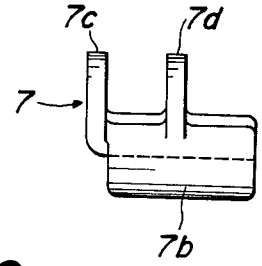
FIG. 10*b* is a plan view of the pressure core shown in FIG. 10*a;*
Figure 10C:
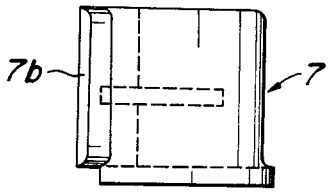
FIG. 10*c* is a side view of the pressure core shown in FIG. 10*a;*

In front of the front vertical plate 2 an annular plate 5 is fixed thereto by means of three connecting shafts 4 (FIGS. 4–6). A base of an arm 6 shown in FIG. 8 is rockably fitted on each of the three connecting shaft 4 between the front vertical and annular plates 2 and 5 as shown in FIG. 9. To free end of each the arm 6 is connected by a pin 8 a pressure core 7 formed by dividing an annular body into three parts. FIGS. 10*a*–10*c* illustrate in detail the pressure core 7 including an inner peripheral surface 7*a,* an overlapping piece 7*b* associated with the adjacent pressure core and brackets 7*c* and 7*d* formed with connecting apertures 7*e.*

As shown in FIG. 9, the front vertical plate 2 is provided at a location outwardly of each the arm 6 with a pin 9 extending therefrom, and each the arm 6 is provided at its mid portion with a pin 6*a* extending therefrom. A spring 10 is extended under tension between the pin 9 and the pin 6.

Figure 11B:
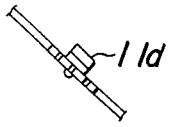
FIG. 11*b* is a partial view of the cam plate as viewed in a direction of an arrow X in FIG. 11*a;*
Figure 11A:
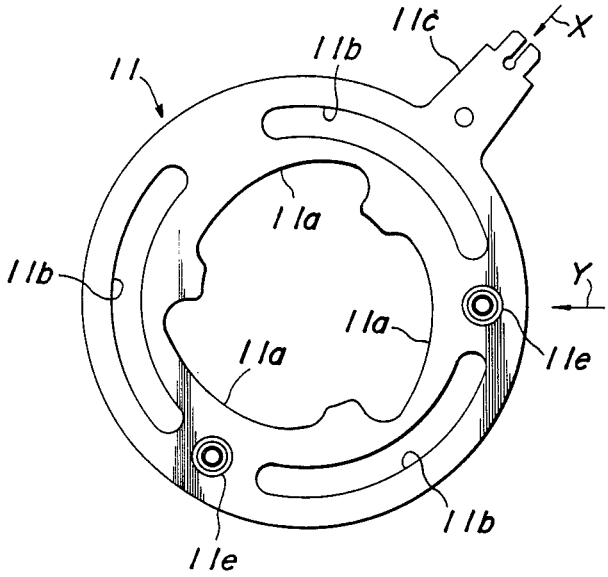
FIG. 11*a* is an elevation of a cam plate shown in FIG. 9 as viewed from on the rear side.
Figure 11C:
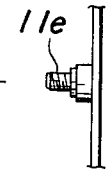
FIG. 11*c* is a partial view of the cam plate as viewed in a direction of an arrow Y in FIG. 11*a;*

As shown in FIG. 11, there is provided a substantially annular cam plate 11 including three cam surfaces 11*a* formed in its inner periphery, three arc-shaped slots 11*b* and a operating protrusion or lever 11*c* for rotating the cam plate 11. The annular cam plate 11 comprises a slide anchoring piece 11*d* slidably fitted in the arc-shaped slot 2*b* of the front vertical plate 2 and two connecting screws 11*e* extending on a rear side of the cam plate 11.

Figure 12:
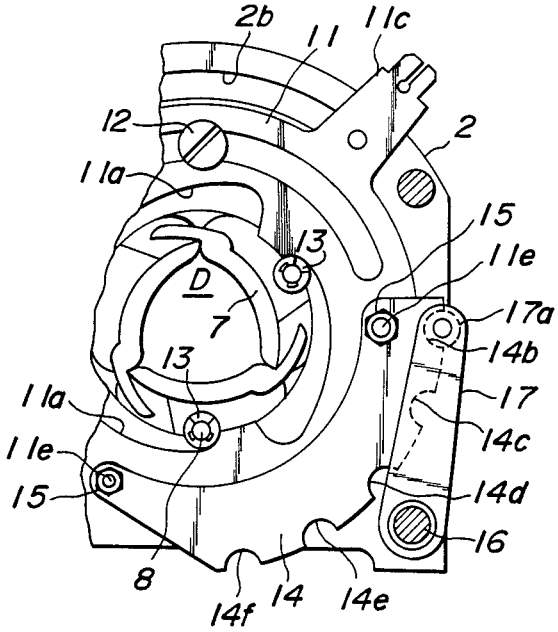
FIG. 12 is a rear view of a rear vertical plate assembly of the crimper according to the invention.

The cam plate 11 is brought into contact with a rear surface of the front vertical plate 2 as shown in FIG. 12 and attached thereto by threadedly engaging set screws 12 passing through the arc-shaped slots 116 into the connecting shafts 4 and fitting the slide anchoring piece 11*d* in the arc-shaped slot of the front vertical plate 2 in a manner such that the cam plate 11 is rotatable relative to the front vertical plate 2 within the range of the arc-shaped slots 2*b* and 11*b.* As shown in FIG. 12, moreover, each roller 13 is provided on a rear extension of the connecting pin 8 so as to be in sliding contact with each the cam surface 11*a.*

Figure 13:
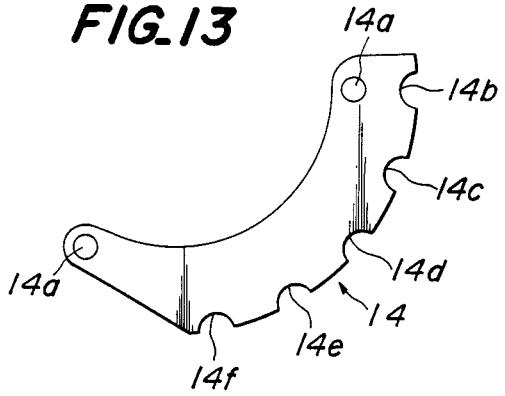
FIG. 13 is a rear view of a positioning plate for the cam plate shown in FIG. 11*a;*

There is further provided a substantially arc-shaped positioning plate 14 including apertures 14*a* for the connecting screw 11*e* and semicircular notches 14*b*–14*f* distributed in an outer periphery of the plate 14, whose number corresponds to that of coins to be applied to the crimper, (five notches in this embodiment for Japanese coins of 500, 100, 50, 10 and 1 yen as shown in FIG. 13.)

The positioning plate 14 is fixed to the cam plate 11 by means of the connecting screws 11*e* of the cam plate 11 passing through the apertures 14*a* tightened by nuts 15 as shown in FIG. 12. A lever 17 is pivotally connected at its bottom end to one of the connecting shafts 16 provided at four corners of the front and rear vertical plates 2 and 3 and is provided at its upper end with a cylindrical pin 17*a* extending therefrom adapted to fit in the notches 14*b*–14*f.* The lever 17 is normally rotatively urged in a counterclockwise direction as viewed in FIG. 12 by means of a spring 18 fitted on a boss 17*b* of the lever 17 (FIG. 5).

A substantially square intermediate vertical plate 19 is provided on mid portion of each the connecting shaft 16. A center rotary shaft 20 extends through the intermediate vertical plate 19 and the rear vertical plate 3 with the aid of bearings 21 and 22 provided in the rear and intermediate vertical plates 3 and 19.

Figure 14A:
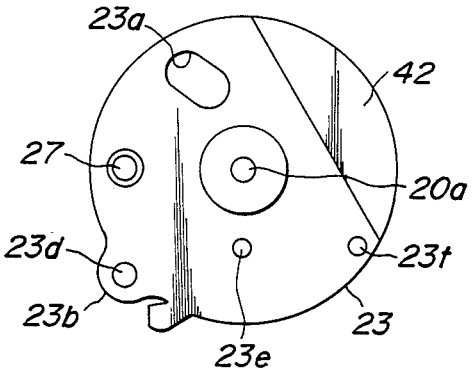
FIG. 14*a* is a front elevation of a disc fixed to a center rotary shaft of the crimper according to the invention.
Figure 14B:
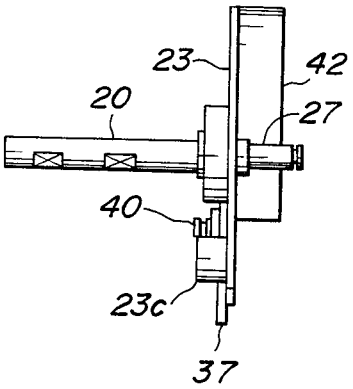
FIG. 14*b* is a side view of the disc shown in FIG. 4*a;*
Figure 14C:
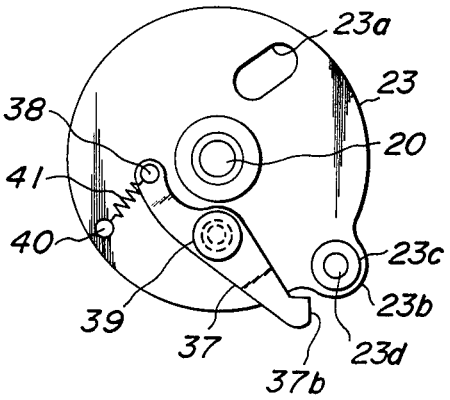
FIG. 14*c* is a rear elevation of the disc shown in FIG. 14*a;*
Figure 15:
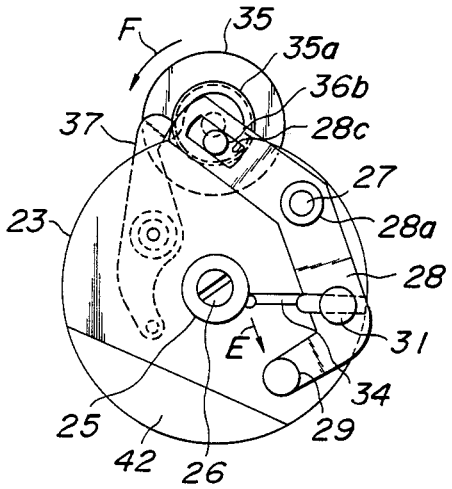
FIG. 15 is a front elevation of a curling mechanism arranged on the disc shown in FIG. 14*a;*
Figure 16:
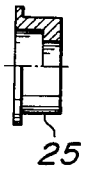
FIG. 16 is a partial sectional view of a stopper used in the mechanism shown in FIG. 15.
Figure 17A:
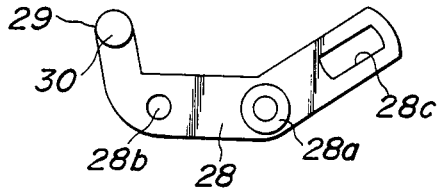
FIG. 17*a* is a front elevation of a lever shown in FIG. 15.
Figure 17B:
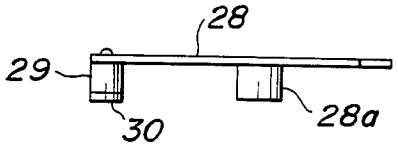
FIG. 17*b* is a plan view of the lever shown in FIG. 17*a;*
Figure 18:
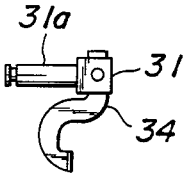
FIG. 18 is a side view of a nail and a nail holder shown in FIG. 15.
Figure 19:
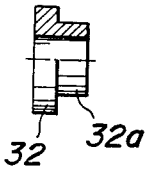
FIG. 19 is a partial sectional view of a bushing to be fitted on a shaft of the nail holder shown in FIG. 15.

Referring to FIGS. 5, 6, 14 and 15, a disc 23 is fixed to a front end of the center rotary shaft 20 having a front end 20*a* (FIG. 14) to which a stopper 25 enlarged shown in FIG. 16 is fixed through a washer 24 by means of a set screw 26 (FIG. 15). A shaft 27 extends from the proximity of an outer periphery of the disc 23, onto which a boss 28*a* of a lever 28 shown in detail in FIGS. 17*a* and 17*b* so as to permit the lever 28 to be rockable relative to the disc 23. The lever 28 is provided on its one end with a roller 29 secured thereto by means of a shouldered stud 30 and is formed between the roller 29 and the boss 28*a* with an aperture 28*b* through which passes a shaft 31*a* of a nail holder 31 shown in FIG. 18. Onto the extending end of the shaft 31*a* is fitted a bushing 32 shown in FIG. 19 and is prevented from removing therefrom by means of a snap ring 33 (FIGS. 5 and 6). In this case, moreover, a reduced diameter portion 32*a* of the bushing 32 is rockably fitted in an elongated slot 23*a* of the disc 23 (FIG. 14*a*). A nail 34 is fixed to the nail holder 31. As shown in FIG. 17*a,* the lever 28 is formed in the other end with an elongated slot 28*c* whose purpose will be explained later.

Figure 20A:
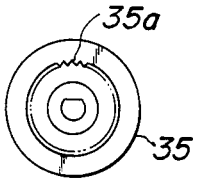
FIG. 20*a* is a front elevation of a dial shown in FIG. 15.
Figure 20B:
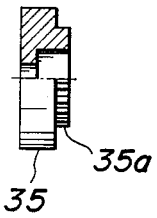
FIG. 20*b* is a partial sectional view of the dial shown in FIG. 20*a;*
Figure 21A:
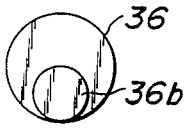
FIG. 21*a* is a front elevation of an eccentric cam used in the curling mechanism shown in FIG. 15.
Figure 21B:
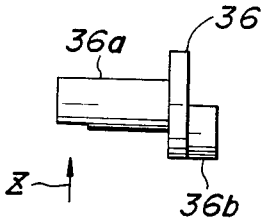
FIG. 21*b* is a side view of the eccentric cam shown in FIG. 21*a;*
Figure 21C:
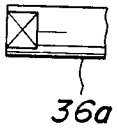
FIG. 21*c* is a partial view of the eccentric cam as viewed in a direction of an arrow Z in FIG. 21*b;*

As shown in FIGS. 14*a*–14*c,* the disc 23 is formed at its outer periphery with a protrusion 23*b* extending therefrom and on the opposite side with a boss 23*c* onto which a dial 35 shown in FIGS. 20*a* and 20*b* is fitted. A shaft portion 36*a* of an eccentric cam 36 shown in FIGS. 21*a*–21*c* is inserted into the boss 23*c* from the side opposite to the dial with respect to the disc 23 and is fixed to the dial 35. An eccentric shaft 36*b* of the eccentric cam 36 is slidably fitted in the elongated slot 28*c* of the lever 28 (FIG. 15).

The dial 35 is formed on its reduced diameter portion with teeth 35*a* shown in FIGS. 20*a* and 20*b* equally angularly distributed thereon and dividing the circumference into equal thirty-six parts and is knurled on its larger diameter portion.

Figure 22:
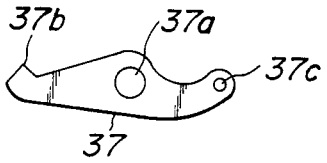
FIG. 22 is a front elevation of a positioning lever shown in FIG. 15.

As shown in FIG. 22, there is provided a positioning lever 37 formed at its mid portion with a pivotal aperture 37*a* and at its one end with a claw 37*b* adapted to engage the teeth 35*a* of the dial 35. The positioning lever 37 is further formed in the other end with an aperture 37*c* into which a spring anchoring pin 38 is planted as shown in FIG. 14*c*.

Figure 23:
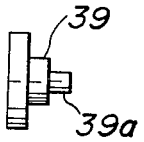
FIG. 23 is a side view of a shouldered stud for pivotally supporting the positioning lever shown in FIG. 22.

The disc 23 is further formed with an aperture 23*e* for fitting therein a reduced diameter portion 39*a* of a shouldred stud 39 enlarged shown in FIG. 23 and with an aperture 23*f* for planting a spring anchoring pin 40 as shown in FIG. 14*a*.

The shouldered stud 39 is inserted in the pivotal aperture 37*a* of the lever 37 and the reduced diameter portion 39*a* of the shouldered stud 39 is fitted in the aperture 23*e* of the disc 23 and fixed thereto by calking or staking, thereby pivotally supporting the lever 37 relative to the disc 23 by means of the stud 39 as shown in FIG. 14*c*. A spring 41 is arranged under tension between the spring anchoring pin 38 planted in the end of the lever 37 and a spring anchoring pin 40 planted in the disc 23 to urge the claw 37*b* of the lever 37 against the teeth 35*a* of the dial 35. Moreover, a reference numeral 42 in FIGS. 14*a* and 14*b* denotes a balance weight fixed to one end of the disc 23.

A motor 45 is fixed to a motor fixing plate 44 upstandingly provided fixed through three connecting rods 43 to the rear vertical plate 3 on its rear side for driving the center rotary shaft 20 as shown in FIGS. 5, 6, 24 and 25. To a motor shaft of the motor 45 is fixed a pinion 46 adapted to be in mesh with a gear 47 fixed to a rear end of the center rotary shaft 20. A reference numeral 48 denotes a switch fixed to the rear vertical plate 3 for a source for the motor 45, which comprises a push button 48*a* for switching on and off the motor, an actuating member 48*b* made of a leaf spring in connection with the push buttons 48*a* and an operating lever 49 for operating the switch.

Figure 24:
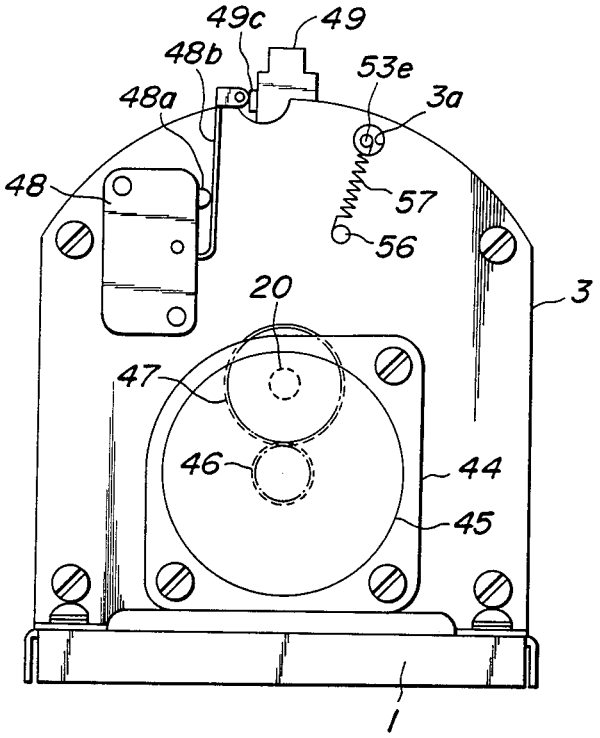
FIG. 24 is a rear view of the crimper shown in FIG. 4.
Figure 25:
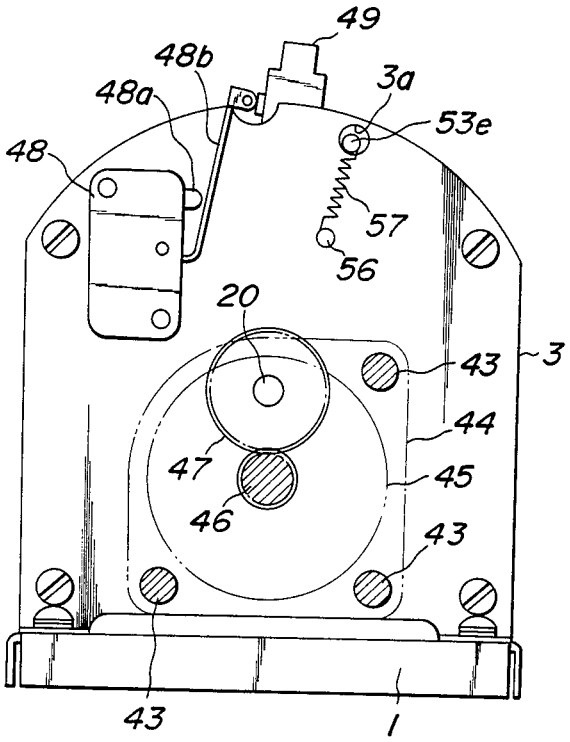
FIG. 25 is a rear view of the crimper after removal of a motor fixing plate.

In FIG. 25, the lever 49 is positioned in its right position, so that the actuating member 48*b* does not contact the push button 48*a*, in which moment the switch 48 is opened and the motor is deenergized. As shown in FIG. 24, on the other hand, when the lever 49 has been moved to the left, the push button 48*a* has also been pushed into the switch 48 by the actuating member 48*b*, so that the switch 48 is closed to energize the motor 45.

When the motor 45 is rotated, the center rotary shaft 20 is also rotated through the pinion 46 and the gear 47, so that the curling mechanism including the disc 23, lever 28, roller 29 and nail 34 and the like is rotated and the dial 35 for adjusting a radial position of the curling mechanism is also rotated together with the disc 23. It is therefore necessary to stop the dial 35 at a predetermined position (the uppermost position in this embodiment) when the curling mechanism is stopped by opening the switch 48 for the motor 45. The reason why such an uppermost position is required is that the dial 35 can be operated only when it is accessible through an opening located at a determined position on a cover (FIGS. 3*a*–3*c*) when it covers the apparatus.

With the apparatus according to the present invention, the dial 35 is therefore needed to stop at a predetermined position. A predetermined position stopping mechanism will be explained hereinafter.

As shown in FIGS. 5 and 6 and FIGS. 26–30, front elevations of the rear vertical plate 3, a substantially circular cam plate 50 is fixed to the center rotary shaft 20 between the rear and intermediate vertical plates 3 and 19. The circular cam plate 50 includes a lower peripheral surface 50*a*, a higher peripheral surface 50*b* and a depression 50*c*.

Figure 31A:
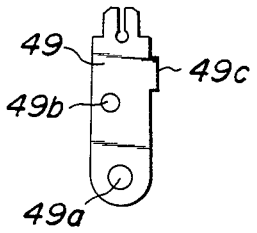
FIG. 31*a* is a front elevation of a switch operating lever used in the crimper according to the invention.
Figure 31B:
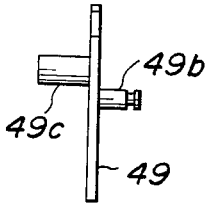
FIG. 31*b* is a side view of the lever shown in FIG. 31*a;*

As shown in FIGS. 31*a* and 31*b*, the operating lever 49 is formed in its lower end with a pivotal aperture 49*a* and on its rear side with an engaging piece 49*c* extending therefrom adapted to engage the actuating member 48*b* and is provided at a mid portion on its front side with a spring anchoring pin 49*b* extending therefrom. The operating lever 49 is rockably supported by a shaft 51 forward extending from the rear vertical plate 3 and fitted in the pivotal aperture 49*a* of the operating lever 49.

Figure 32A:
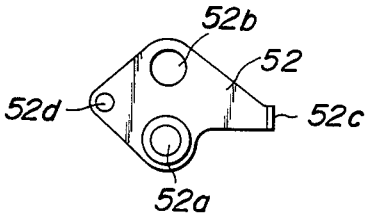
FIG. 32*a* is a front elevation of a rocking plate used in the mechanism shown in FIGS. 27–30.
Figure 32B:
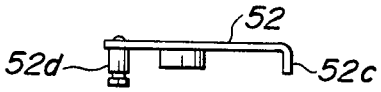
FIG. 32*b* is a plan view of the rocking plate shown in FIG. 32*a;*

FIGS. 32*a* and 32*b* illustrate a rocking plate 52 in detail which is formed in its lower boss with a shaft aperture 52*a* and in its upper portion with an upper aperture 52*b* and is provided with an engaging piece 52*c* formed by forward bending a right-hand end as viewed in FIG. 32*a* and with a spring anchoring pin 52*d* forward extending from a left-hand end of the rocking plate. The shaft aperture 52*a* of the rocking plate 52 is fitted on the shaft 51 and the upper aperture 52*b* is loosely fitted on the spring anchoring pin 49*b* so as to rockably support the rocking plate 52.

Figure 26:
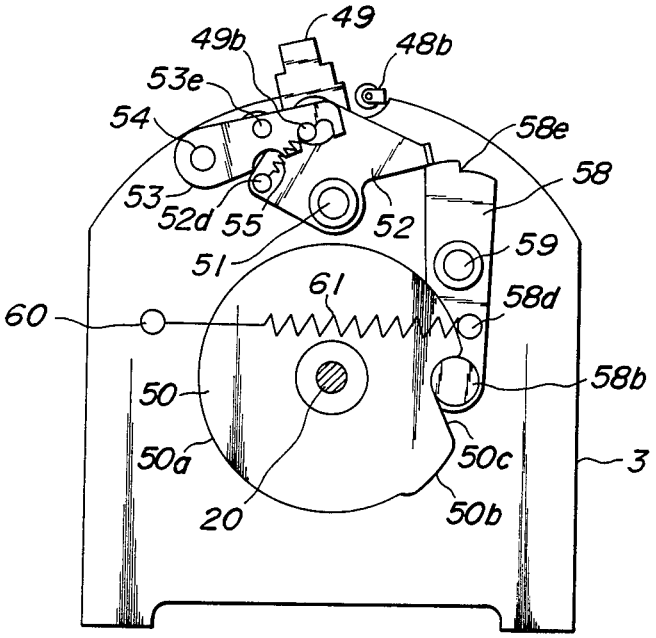
FIG. 26 is a front elevation illustrating a predetermined position stopping mechanism for the dial arranged on a rear vertical plate according to the invention.
Figure 33A:
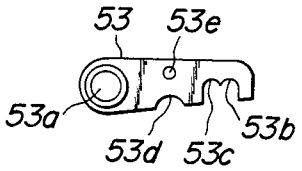
FIG. 33*a* is a front elevation of a positioning arm used in the mechanism shown in FIGS. 27–30.
Figure 33B:
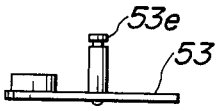
FIG. 33*b* is a plan view of the positioning arm shown in FIG. 33*a;*

FIGS. 33*a* and 33*b* illustrate a positioning arm 53 in detail which includes an shaft aperture 53*a* in a boss, pin anchoring grooves 53*b* and 53*c* formed in a lower edge of a free end of the arm, a notch 53*d* formed in a lower edge at a mid portion and a spring anchoring pin 53*e* rearward extending from an upper edge at the mid portion. The shaft aperture 53*a* of the arm is fitted on a shaft 54 forward extending from an upper left corner (as viewed in FIG. 26) of the rear vertical plate 3 and the spring anchoring pin 53*e* is fitted in an aperture 3*a* (FIGS. 24 and 25) of the rear vertical plate 3 so as to support the positioning arm 53 permitting its free end to somewhat vertically move. A spring 55 is arranged under tension between the spring anchoring pins 49*b* and 52*d* as shown in FIG. 26 and a spring 57 is also arranged under tension between the spring anchoring pin 53*e* of the arm 53 and a spring anchoring pin 56 extending from the rear surface of the rear vertical plate 3 as shown in FIGS. 24 and 25.

Figure 34A:
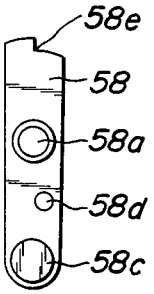
FIG. 34*a* is a front elevation of a rocking rod used in the mechanism shown in FIGS. 27–30.
Figure 34B:
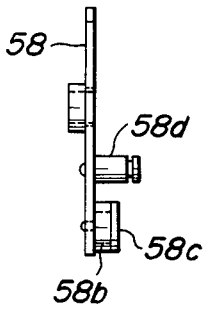
FIG. 34*b* is a side view of the rocking rod shown in FIG. 34*a.*

FIGS. 34*a* and 34*b* illustrate a rocking rod 58 in detail which includes a shaft aperture 58*a* of a boss rearward extending from a mid portion of the rod, a roller 58*b* rotatably supported by a stud 58*c* provided at a lower end of the rod on its front side, a spring anchoring pin 58*d* and a shoulder 58*e* formed in an upper end. As shown in FIG. 26, the shaft aperture 58*a*, is fitted on a shaft 59 extending from the rear vertical plate 3 to rockably support the rocking rod 58 so that the roller 58*b* is in opposition to the cam plate 50. A spring 61 is arranged under tension between the spring anchoring pin 58*d* of the rocking rod 58 and a spring anchoring pin 60 extending from the rear vertical plate 3.

The operation of the coin package crimper constructed as above described according to the invention will be explained in hereinafter.

Figure 1:
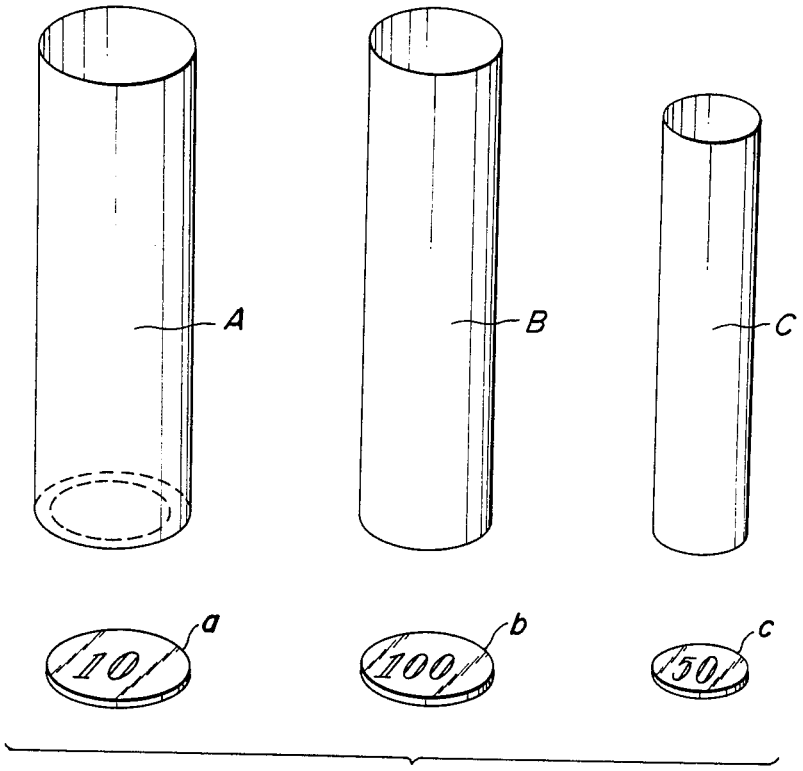
FIG. 1 is a perspective view of various kinds of coins and paper packages therefor.
Figure 2:
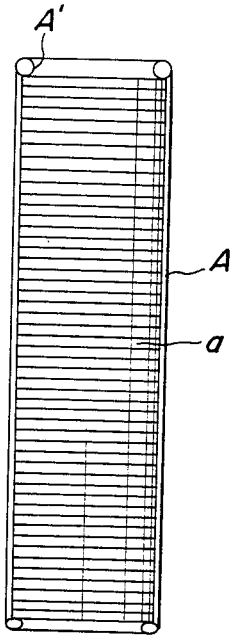
FIG. 2 is a sectional view of a package completely packed coins therein.

In order to obtain the coin package as shown in FIG. 2 by curling the edge of the open end edge after coins have been packed in the hollow cylindrical packing paper as shown in FIG. 1, the open end of the package is first inserted into a center opening D of the crimper shown in FIG. 4. In this case, a diameter of the opening D must be adjusted depending upon diameters of the cylindrical packages which in turn vary depending upon kinds of coins to be packed.

FIG. 4 illustrates the opening D whose diameter is the minimum. In this condition, the operating lever 11c for the cam plate 11 assumes the leftmost position as viewed in FIG. 4 and the cylindrical pin 17a is fitted in the uppermost notch 14b of the plate 14 to hold the cam plate 11 in this condition. In this case, moreover, the rollers 13 integrally provided on the pressure core 7 abut against the shallowest portions of the cam surfaces 11a of the cam plate 11, so that the three pressure cores 7 assume the innermost positions to provide the smallest diameter of the opening D which corresponds to the Japanese one yen coins in this embodiment.

In order to enlarge the opening D, the operating lever 11c of the cam plate 11 is moved in a direction E in FIG. 4. In this manner, when the cam plate 11 is rotated in a clockwise direction as viewed in FIG. 4, the lever 17 is rotated outwardly against the force of the spring 18 and simultaneously the cylindrical pin 17a leaves the uppermost notch 14b of the positioning plate 14 and enters the next notch 14c. At the same time, the rollers 13 abut against deeper portions of the cam surfaces 11a with the aid of the springs 10 (FIG. 9), so that the pressure cores 7 assume somewhat outwardly expanded positions to increase the diameters of the opening D which corresponds to the Japanese fifty yen coins.

In this manner above described, the cam plate 11 is progressively rotated in the clockwise direction to enlarge the diameter of the opening D correspondingly. When the cylindrical pin 17a is fitted in the third notch 14d, the opening D corresponds to the Japanese hundred yen coins. The fourth notch 14e is for the Japanese ten yen coins, and the fifth notch 14f is for the five hundreds yen coins.

In addition to the adjustment of the diameter of the opening D by the pressure cores 7, it is necessary to adjust the radial position of the curling mechanism for open edges of packages comprising the roller 29, nail 34 and the like shown in FIGS. 5 and 15. Such an adjustment of the radial position is carried out in the following manner.

In FIG. 15, the eccentric shaft 36b of the eccentric cam 36 fixed to the dial 35 assumes its innermost position which is nearliest to the center of the disc 23, so that the radial distance of the roller 29 provided on one end of the lever 28 pivotally mounted at the shaft 27 is approximately the maximum value. Accordingly, this condition corresponds to the Japanese five hundreds yen coins. Under this condition, after the motor 45 is energized to rotate the disc 23, the open end of the cylindrical coin package is inserted into the opening D so that the open edge is subjected to the curling action by being embraced between the nail 34 and the inner surface of the roller 29 rotating together with the disc 23 to be curled as shown by A' in FIG. 2. When the disc 23 is rotated, the nail 34 is rotated in a direction shown by an arrow E by the centrifugal force to achieve the curling action.

When the dial 35 is rotated in a direction, for example, shown by arrow F from the position in FIG. 15, the eccentric shaft 36b is also rotated in a counterclockwise direction to cause the lever 28 to rotate about the shaft 27 in a clockwise direction, thereby reducing the radial distance of the roller 29 from its revolution center. Accordingly, if indices (not shown) are provided on the dial 35 corresponding to the various coins, the curling mechanism can be adapted to any one of the various coins by operating the dial to select any one of the indices.

Moreover, the claw 37b is engaged with the teeth 35a of the dial 35 to hold the dial in position. As shown in FIG. 14, for this purpose, the claw 37b of the positioning lever 37 is normally urged into engaged with the teeth 35a by the action of the spring 41. When the dial 35 is manually rotated, the claw 37b moves relative to the dial 35 beyond its teeth 35a against the tensile force of the spring 41.

Operations of driving means for the center rotary shaft 20 and the predetermined position stopping mechanism for the dial 35 will be explained hereinafter.

Figure 27:
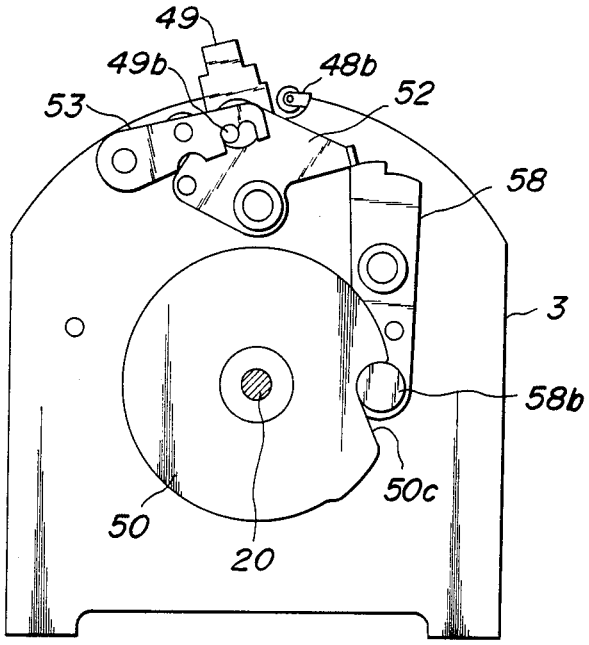
FIGS. 27–30 are front elevations of the predetermined position stopping mechanism after removal of a spring in FIG. 26 for explaining the operation of the mechanism.

FIGS. 25, 26 and 27 illustrate the operating lever 49 for operating the switch 48 inclined to the left as viewed in FIGS. 26 and 27 to open the switch 48. In other words, when the lever 49 is operated into its open position, the actuating member 48b of the switch 48 moves away from the push button 48a by the spring force of the actuating member itself as shown in FIG. 25 to open the circuit for the switch 48 so as to stop the motor 45.

In this condition, moreover, the pin 49b on the lever 49 engages the pin anchoring groove 53c of the arm 53 (FIG. 33a) and the arm 53 is urged downward by means of the spring 57 (FIG. 25), so that the lever 49 is held in its opening position.

Figure 28:
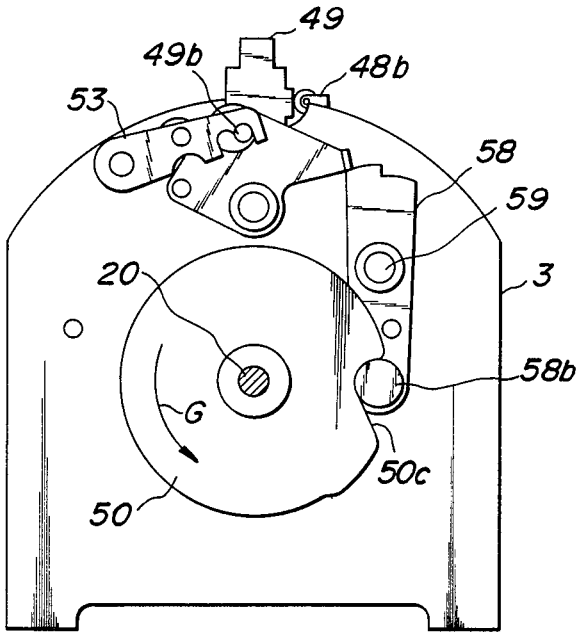

When the lever 49 is operated into the right as viewed on the front side as shown in FIGS. 24 and 28, the arm 53 is once raised against the force of the spring 57 by the pin 49b which then moves from the pin anchoring groove 53c to the groove 53b to hold the lever 49 in its closing position. When the lever 49 is in the closing position, the engaging piece 49c of the lever 49 forces the push button 48a into the switch 48 through its actuating member 48b to close the switch 48 so as to energize the motor 45.

When the motor 45 is energized, the center rotary shaft 20 is rotated through the pinion 46 and the gear 47, the disc 23 and cam plate 50 are rotated in a direction shown by an arrow G in FIG. 28. If the disc 23 is rotated, the curling mechanism is rotated to curl the open end edge of the coin package in the manner above described.

Figure 29:
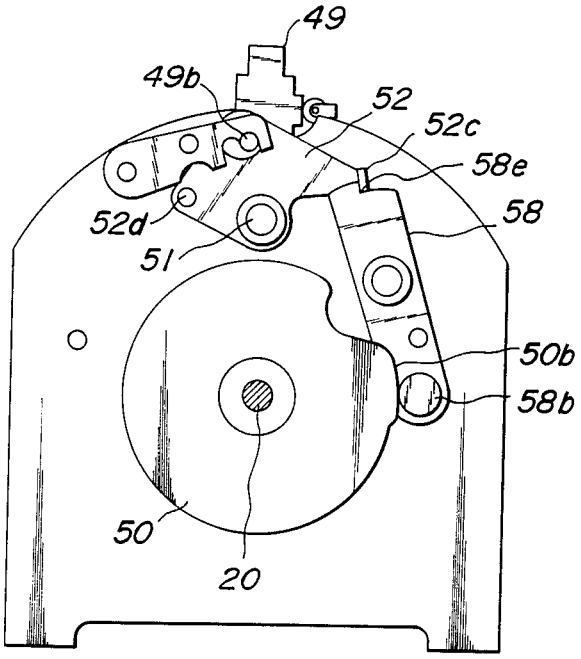

On the other hand, when the cam plate 50 is rotated in the direction of the arrow G in FIG. 28, the roller 58b fitted in the depression 50c of the cam plate 50 is pushed out therefrom with the aid of an oblique surface of the depression 50c, so that the rocking rod 58 is rotated about its shaft 59 in the counterclockwise direction against the force of the spring 61 (FIG. 26), with the result that the roller 58b rides on the higher peripheral surface 50b of the cam plate 50 and the rocking rod 58 is tilted to the left to the largest extent as shown in FIG. 29. On the other hand, the rocking plate 52 pivotally mounted on the shaft 51 is normally rotatively urged in a clockwise direction by means of the spring 55 (FIG. 26) arranged under tension between the pin 49b of the lever 49 and the pin 52d of the rocking plate 52, so that the engaging piece 52c of the rocking plate 52 engages the shoulder 58e of the rocking rod 58 when the shoulder 58e arrives in the position shown in FIG. 29. As the result, the rocking rod 58 is held in its anchoring position so that the cam plate 50 is rotated together with the center rotary shaft 20 without any obstruction.

Figure 30:
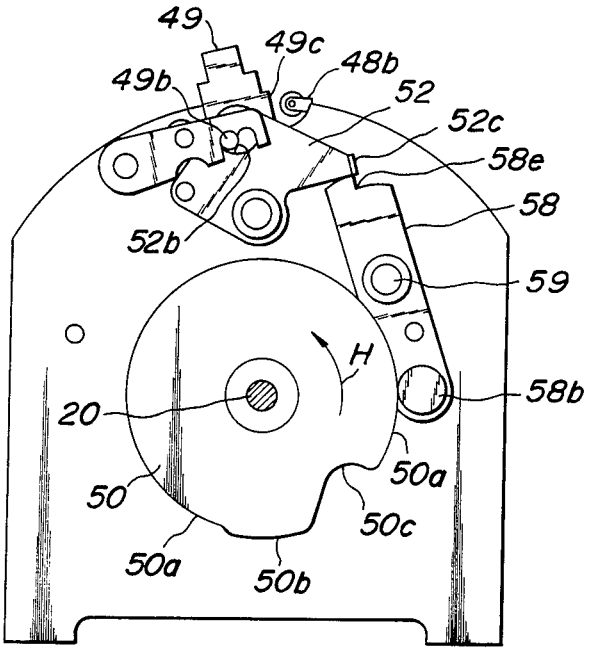

When the lever 49 is then operated into its opening position as shown in FIG. 30, the engaging piece 49c of the lever 49 does not urge the actuating member 48b and therefore the push button 48a extends outwardly as shown in FIG. 25 to open the circuit for the switch 48. As the result, the power for the motor 45 is turned off, but its rotor tends to rotate further owing to its inertia.

On the other hand, with the above mentioned operation of the lever 49, the pin 49*b* provided on the lever 49 causes through the upper aperture 52*b* the rocking plate 52 to rotate in a counterclockwise direction, so that the engaging piece 52*c* of the rocking plate 52 disengages from the shoulder 58*e* of the lever 58. As a result, the lever 58 is forced to rotate about the shaft 59 is a clockwise direction by the action of the spring 61 (FIG. 26). In this case, however, the cam plate 50 now assumes the position shown in FIG. 30, so that the rocking rod 58 could not rotate further, because the roller 58*b* of the rocking rod 58 is in rotative contact with the lower peripheral surface 50*a*. Since, however, the cam plate 50 rotates further in a direction H in FIG. 30 owing to the inertia to assume the position shown in FIGS. 26 and 27, the roller 58*b* is received in the depression 50*c* of the cam plate 50 with the aid of the force of the spring 61, so that the cam plate 50 is held against rotation and simultaneously the disc 23 fixed to the center rotary shaft 20 is also stopped in the position shown in FIG. 15. Accordingly, the dial 35 held on the disc 23 is stopped at the predetermined position (the uppermost position in this embodiment) without fail, so that the operation of the dial can be effected with ease as above described.

As can be seen from the above description, the coin crimper according to the invention is capable of changing the diameter of the opening for inserting open ends of coin packages by rotatively operating the protrusion or lever of the cam plate and capable of changing the radial positions of the nail and roller of the curling mechanism for curling the open end edges of the coin packages so as to be able to curl open end edges of packages for all kinds of coins having different diameters, thereby obtaining significant effects to facilitate handling of coin crimper and to remarkably improve its working efficiency.

It is further understood by those skilled in the art that the foregoing description is that of preferred embodiments of the disclosed coin crimper and that various changes and modifications may be made in the invention without departing from the spirit and scope thereof.

What is claimed is:

1. A coin crimper for curling open end edges of packages with coins packed therein, said crimper including a package receiving opening, curling means for curling the open end edges of the packages inserted in said opening and driving means for rotatively driving said curling means, said coin crimper comprising package receiving opening diameter changing means for changing a diameter of said package receiving opening depending upon kinds of coins and hence packages of the coins, and curling position changing means for changing a curling position where the open end edges of the packages are curled depending upon the coins, thereby enabling packages of coins having different diameters to be curled by the single coin crimper, said package receiving opening diameter changing means comprising a plurality of pressure cores forming at their insides a substantially circular opening for receiving said open ends of the packages, each of said pressure cores being supported by a rockable arm and having a roller, said rockable arm being pivotally supported relative to the crimper and urged in one direction by spring means and a cam plate rotatable about said package receiving opening and fixed at predetermined positions and having inner peripheral cam surfaces each contacting said roller of said pressure core, thereby changing a diameter of said circular opening formed by said pressure cores when said cam plate is rotated to move said pressure cores into positions determined by said inner peripheral cam surfaces of the cam plate and said rollers of said pressure cores.

2. A coin crimper as set forth in claim 1, wherein said curling position changing means comprises a disc rotatively driven by said driving means, a lever pivotally supported on said disc and having at one end a roller and a nail cooperating with said roller to curl the open end edges of the coin packages, a dial rotatively supported on said disc and having an eccentric shaft engaging said lever so as to rotate it when said dial is rotated to change a radial position of said roller on the lever and positioning means for said dial.

3. A coin crimper as set forth in claim 2, wherein said eccentric shaft of said dial is formed by an eccentric shaft of an eccentric cam whose main shaft portion is concentrically fitted in said dial, and said eccentric shaft of the eccentric cam is slidably fitted in an elongated slot of said lever pivotally supported on said disc.

4. A coin crimper as set forth in claim 2, wherein said positioning means for said dial comprises teeth formed in a circumferential surface of said dial and a positioning lever pivotally mounted on said disc and resiliently urged to said dial by spring means and formed with a claw which normally engages with said teeth on said dial.

5. A coin crimper as set forth in claim 1, wherein said cam plate comprises a positioning plate fixed thereto having notches whose number corresponds to the number of kinds of coins to be packed and a lever pivotally supported relative to the crimper and urged toward said positioning plate by spring means and having a roller received in said notches of said positioning plate, thereby enabling the cam plate to be held at said predetermined positions and to be rotated against a force of said spring means holding said roller of said lever in the notches of said positioning plate.

6. A coin crimper as set forth in claim 1, wherein said driving means comprises a switch operating lever for operating a circuit for a motor of said driving means and pivotally mounted on said crimper to move into positions for closing and opening said circuit, and an arm pivotally mounted on said crimper resiliently urged into one direction and formed with two pin anchoring grooves corresponding to said positions of said switch operating lever, said switch operating lever being further provided with a pin which is fitted in said pin anchoring grooves of said arm, respectively when said switch operating lever is in said circuit closing and opening positions, thereby holding said switch operating lever in the positions.

7. A coin crimper as set forth in claim 6, wherein said driving means further comprises a cam plate in the form of a circular disc concentric to and rotatable together with said curling means and having a lower peripheral cam surface, a higher peripheral cam surface and a depression in its outer circumference, a rocking rod pivotally mounted on said crimper and having a shoulder and a roller engaging said cam surfaces and depression of said cam plate and urged thereagainst by spring means, and a rocking plate pivotally mounted on said crimper and resiliently urged in one direction by spring means and having an engaging piece, whereby when said switch operating lever is moved into the closing position, said roller of the rocking rod rides on the higher peripheral cam surface to rock said rocking rod so as to permit said shoulder to engage said engaging piece of the rocking plate thereby locking said rocking rod in its present position to enable the curling the packages to be effected, and when said switch operating lever is moved into the opening position, the rocking plate is rocked to disengage said engaging piece from said shoulder of the rocking rod thereby bring said roller of said rocking rod into contact with the lower peripheral cam surface to permit the cam plate to rotate further by an inertia force until said roller of the rocking rod fits in said depression of the cam plate, thereby stopping said dial at a determined position.

* * * * *